US005564104A

United States Patent [19]

Pourfarzaneh

[11] Patent Number: 5,564,104

[45] Date of Patent: Oct. 8, 1996

[54] METHODS OF REMOVING RADIOACTIVELY LABLED BIOLOGICAL MOLECULES FROM LIQUID RADIOACTIVE WASTE

[75] Inventor: Matt Pourfarzaneh, Alameda, Calif.

[73] Assignee: Cortex Biochem, Inc., San Leandro, Calif.

[21] Appl. No.: 255,229

[22] Filed: Jun. 7, 1994

Related U.S. Application Data

[63] Continuation-in-part of Ser. No. 73,039, Jun. 8, 1993, abandoned.

[51] Int. Cl.[6] ..... G21F 9/00

[52] U.S. Cl. ..... 588/20; 210/682

[58] Field of Search ..... 210/682; 588/2, 588/6, 8, 11, 20

[56] References Cited

U.S. PATENT DOCUMENTS

| | | | |
|---|---|---|---|
| 2,752,309 | 6/1956 | Emmons . | |
| 3,791,930 | 2/1974 | Saxholm . | |
| 3,843,450 | 10/1974 | Saxholm . | |
| 3,902,849 | 9/1975 | Barak . | |
| 3,981,776 | 9/1976 | Saxholm . | |
| 3,985,608 | 10/1976 | Saxholm . | |
| 4,020,003 | 4/1977 | Steinberg . | |
| 4,033,868 | 7/1977 | Meichsner et al. | 210/38 |
| 4,104,026 | 8/1978 | Brooker . | |
| 4,140,582 | 2/1979 | Saxholm . | |
| 4,213,825 | 7/1980 | Saxholm . | |
| 4,324,859 | 4/1982 | Saxholm . | |
| 4,371,624 | 2/1983 | Saxholm . | |
| 4,642,203 | 2/1987 | Matsunaga et al. | 252/631 |
| 4,643,981 | 2/1987 | Card . | |
| 4,645,625 | 2/1987 | Lundstrom | 252/631 |
| 4,657,868 | 4/1987 | Saxholm . | |
| 4,687,581 | 8/1987 | Macedo et al. | 210/670 |
| 4,695,392 | 9/1987 | Whitehead . | |
| 4,780,239 | 10/1988 | Snyder et al. | 252/184 |
| 4,800,042 | 1/1989 | Kurumada et al. | 252/628 |
| 4,853,130 | 8/1989 | D'Angelo et al. | 210/663 |
| 4,879,006 | 11/1989 | Turner | 204/1.5 |
| 4,902,665 | 2/1990 | Elfline | 502/402 |
| 4,992,377 | 2/1991 | Saxholm . | |
| 4,995,984 | 2/1991 | Barkatt . | |
| 5,024,767 | 6/1991 | Kubo . | |
| 5,096,624 | 3/1992 | Dörr et al. | 252/631 |
| 5,122,268 | 6/1992 | Burack et al. | 210/202 |

OTHER PUBLICATIONS

Pourfarzaneh, M., et al., "The Use of Magnetizable Particles in Solid Phase Immunoassay", *Methods of Biochemical Analysis,* vol. 28, pp. 267–295, (1982).

Pourfarzaneh, M., et al., "Cortisol Directly Determined in Serum by Fluoroimmunoassay with Magnetizable Solid Phase", *Clinical Chemistry,* vol. 26, No. 6, pp. 730–733, (1980).

Al–Dujaili, E. A. S., et al., "Development and Application of an Automated Direct Radioimmunoassay for Plasma Aldosterone", *Journal of Endocrinology,* vol. 81, p. 111, (1979).

Nargessi, R. D., et al., "Solid–Phase Fluoroimmunoassay of Human Albumin In Biological Fluids", *Clinica Chimica Acta,* vol. 89, pp. 455–460, (1978).

Ratcliffe, J. G., "Separation Techniques In Saturation Analysis", *Br. Med. Bull.,* vol. 30, No. 1, pp. 32–37, (1974).

Yalow, R. S., "Protein and Polypeptide Hormones", *Exc. Med. Found. Int. Congr. Ser.,* vol. 161, pp. 627–631, (1968).

Arthur A. Hancock, A Rapid Economical Technique for Kenowing Radioactivity from Receptor Binding Assay Aqueous Wastes, Health Physics, vol. 47, No. 4, Oct. 1984, pp. 640–641.

*Primary Examiner*—Ngoclan Mai

*Attorney, Agent, or Firm*—Townsend and Townsend and Crew LLP

[57] ABSTRACT

This invention relates to the processing of liquid radioactive waste containing radioactively labeled biological molecules. More specifically, this invention relates to the use of solid phase binders to remove radioactively labeled biological molecules from liquid radioactive waste solutions.

12 Claims, 3 Drawing Sheets

A, B, C, D CARTRIDGES GANGED TOGETHER, EACH CARTRIDGE CONTAINING A DIFFERENT ADSORBENT EACH HAVING AN AFFINITY FOR A DIFFERENT RADIOISOTOPE LABELED MATERIAL

A, B, C, D CELLS IN CARTRIDGE, EACH CELL CONTAINING A DIFFERENT ADSORBENT EACH HAVING AN AFFINITY FOR A DIFFERENT RADIOISOTOPE LABELED MATERIAL

METHODS OF REMOVING RADIOACTIVELY LABLED BIOLOGICAL MOLECULES FROM LIQUID RADIOACTIVE WASTE

This application is a continuation-in-part of U.S. patent application Ser. No. 08/073,039, filed Jun. 8, 1993.

FIELD OF THE INVENTION

This invention relates to the processing of liquid radioactive waste containing radioactively labeled biological molecules. More specifically, this invention relates to the use of solid phase binders to remove radioactively labeled biological molecules from liquid radioactive waste solutions.

BACKGROUND OF THE INVENTION

There is widespread use of radioactively labeled biological molecules in research, medicine, industry and for environmental testing. For example, a variety of assays employing radiolabled biological molecules are used in biological research and medicine. For instance, there are many different types of immunoassays used in clinical laboratories and in research. There are also a many clinical assays and research procedures using radioactively labeled nucleic acids. A number of different isotopes are used in these different applications including $^{14}C$, $^{3}H$, $^{125}I$, $^{131}I$, $^{32}P$ and $^{57}Co$.

Many of the assays using radioactively labeled biological molecules generate relatively large volumes of low level radioactive waste, which then become a disposal problem. For example, in a typical radioimmunoassay procedure, small amounts of radioactively-labeled material are dispersed into liters of aqueous or organic solutions. These solutions often contain relatively low levels of radioactivity, but nonetheless must be disposed of as radioactive waste according to federal and state regulations.

Disposal of large volumes of low level radioactive liquid waste generated by radioimmunoassays and other procedures is particularly expensive and difficult. Transportation of radioactive waste materials to federal waste disposal sites has become increasingly difficult and expensive. Disposal of low level liquid radioactive waste by transportation to radioactive waste disposal sites is also an inefficient use of space at these sites. Therefore, most institutions try to reduce or eliminate disposal of radioactive waste by this method.

An additional method of radioactive waste disposal involves storing the radioactive waste material on site until the material is no longer radioactive. Fortunately, some of the most commonly used radioisotopes, such as $^{125}I$ and $^{57}Co$, have relatively short halflives. Because of this, some institutions store radioactive waste containing such isotopes until the waste is no longer radioactive, and then dispose of the waste as nonradioactive material. However, it is difficult to store large volumes of low level radioactive liquid waste for a period of months or years.

There is a need for methods to remove the radioactively labeled biological molecules in concentrated form from liquid radioactive waste solutions. If this can be accomplished, the concentrated radioactively labeled biological molecules can then more feasibly be stored on site until the radioactivity decays and the waste becomes nonradioactive. Alternatively, the amount of radioactive waste material that must be transported to a radioactive waste disposal site can be dramatically reduced. In either case, the expense associated with liquid radioactive waste disposal can be markedly decreased.

SUMMARY OF THE INVENTION

This invention provides for methods of removing radioactively labeled biological molecules from liquid radioactive waste solutions. The liquid radioactive waste solution is contacted with a solid phase binder to form a solid phase binder:radioactively labeled biological molecule complex, which is then separated from the liquid radioactive waste solution. The radioactively labeled biological molecule can be labeled with a gamma emitting radioisotope such as $^{125}I$ or $^{57}Co$. Examples of $^{125}I$-labeled biological molecules include $^{125}I$ thyroxine and $^{125}I$ folate. $^{57}Co$ vitamin B12 is an example of a $^{57}Co$-labeled biological molecule. More than one radioactively labeled biological molecule can be removed from a liquid radioactive waste solution, by more than one solid phase binder.

A variety of different solid phase binders can be added to a liquid radioactive waste solution to form the solid phase binder:radioactively labeled biological molecule complex. For example, the solid phase binder can be a solid phase adsorbent, such as talc, glass wool, glass beads or a charcoal adsorbent. As an additional example, the solid phase binder can be a solid phase immunochemical binder. Preferably, the solid phase immunochemical binder is an antibody attached to a solid phase. An antibody in liquid phase can be added to a liquid radioactive waste solution to bind to a radioactively labeled biological molecule. The liquid phase antibody is then bound by a solid phase immunochemical binder to form the solid phase binder:radioactively labeled biological molecule complex.

The solid phase binder:radioactively labeled biological molecule complex can be removed from the liquid radioactive waste solution in a variety of ways. For example, the solid phase binder can be present in a column and the liquid radioactive waste solution can be passed through the column. The solid phase binder in the column can be, for example, a mixture of celite and charcoal or a polymer resin containing adsorbent particles, such as adsorbent charcoal particles. The column solid phase binder can also be an immunochemical binder, such an antibody attached to a glass bead.

This invention further provides for methods of removing radioactively labeled biological molecules from liquid radioactive waste solutions by contacting a magnetizable particle binder with a liquid radioactive waste solution to form a magnetizable particle binder:radioactively labeled biological molecule complex. The complex is then separated from the liquid radioactive waste solution. For instance, the magnetizable particle binder can be adsorbent particles, such as charcoal adsorbent particles, attached to a magnetizable polymer, such as a magnetizable polyacrylamide gel. For example, charcoal particles can be entrapped in a magnetizable polyacrylamide gel to form a magnetizable particle binder. This magnetizable particle binder can be used, for example, to remove $^{125}I$ folate and $^{57}Co$ vitamin B12 from a liquid radioactive waste solution.

The magnetizable particle binder can also be, for example, a magnetizable particle immunochemical binder, such as an antibody attached to a magnetizable polymer. An antibody in liquid phase can also be added to a liquid radioactive waste solution to bind to a radioactively labeled biological molecule. The liquid phase antibody is then bound by a magnetizable particle immunochemical binder to form the magnetizable particle binder:radioactively labeled biological molecule complex. For example, a mouse anti-thyroxine antibody can be added in liquid phase to a liquid radioactive waste solution to bind $^{125}$I thyroxine. The liquid phase antibody is then bound with a magnetizable particle binder containing a sheep antimouse antibody, in order to remove the $^{125}$I thyroxine from the liquid radioactive waste solution.

DETAILED DESCRIPTION

Introduction

Figure 1:
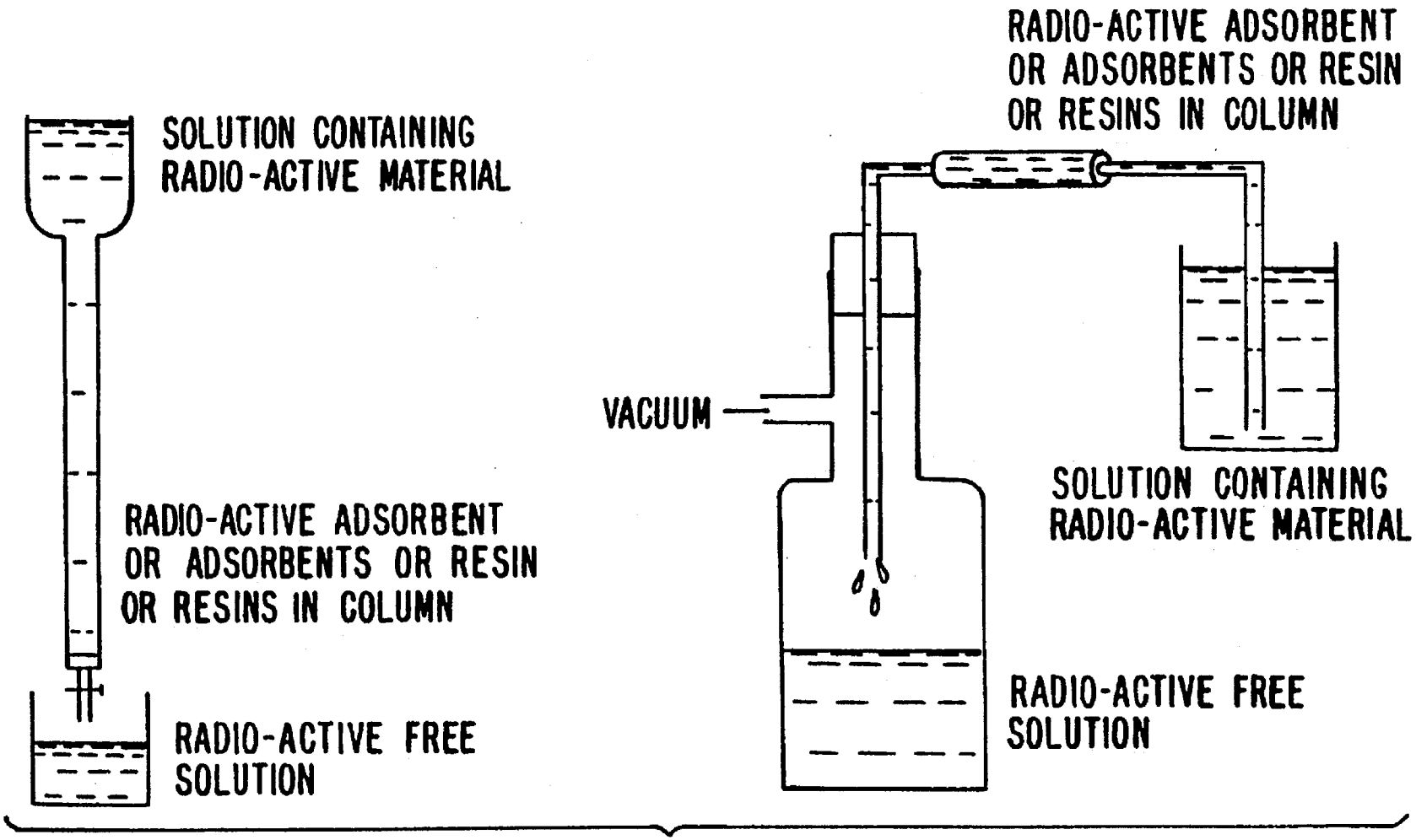
FIG. 1. An adsorbent column capable of adsorbing a variety of radioisotope labeled materials from a solution. A solution containing radioactively labeled materials is passed through a column containing an adsorbent or a mixture of adsorbents by gravity flow or by application of a vacuum.

This invention relates to concentration of liquid radioactive waste containing radioactively labeled biological molecules. The disposal of such liquid radioactive waste presents a problem for many laboratories and institutions. This is particularly true due to the widespread use of procedures such as radioimmunoassays, which generate large volumes of low level liquid radioactive waste. The removal of radioactively labeled molecules from liquid radioactive waste solutions greatly reduces the volume of radioactive waste and therefore facilitates the storage or disposal of radioactive waste.

This invention provides methods for removing a variety of radioactively labeled biological molecules from radioactive waste solutions. The radioactively labeled biological molecules are bound to a solid phase binder and form a complex with the solid phase binder. The solid phase binder is then removed from the radioactive waste solution, which results in the concentration of the radioactive waste.

The term "biological molecule" as used herein refers to carbon-containing molecules, including macromolecules, that are found in a biological source, as well as derivatives, analogues and modifications of such molecules. In addition, the term refers to carbon-containing molecules such as pharmaceuticals, antibiotics and the like which are used in medicine. The term also refers to variety of other biologically significant carbon-containing molecules such as toxins, pesticides and herbicides that may be assayed in medicine or in environmental testing. For example, nucleic acid analogues containing modified bases not found in nature are included as biological molecules. Similarly, any analogue of a molecule found in nature or any chemical modification of such a molecule is also included in the definition of biological molecules. Biological molecules may be isolated from natural sources or synthesized in the laboratory, as, for example, synthetic peptides or oligonucleotides.

The term "radioactively labeled biological molecule", as used herein refers to a biological molecule that is labeled with a radioactive isotope. A variety of different radioisotopes may be used. Typically the radioisotopes used are alpha, beta or gamma emitters. For example, radioisotopes commonly used in radioimmunoassays and other assays and laboratory procedures include $^{14}$C, $^{3}$H, $^{125}$I, $^{131}$I, $^{32}$p and $^{57}$Co. Other radioactive isotopic labels may also be used. The radioisotope may be attached to or incorporated into the biological molecule in a large variety of ways known to those of skill in the art. These methods of attachment can include the preparation of derivatives and modifications of biological molecules for the purpose of radiolabeling.

The methods of the invention relate to the removal of radioactively labeled biological molecules, as defined above from liquid radioactive waste solutions. The terms "liquid radioactive waste solution" or "radioactive waste solution" refer to liquid radioactive waste which contains radioactively labeled biological molecules. Liquid radioactive waste solutions may be aqueous or nonaqueous liquids. For example, the liquid radioactive waste resulting from many radioimmunoassay procedures typically consists of aqueous wash solutions containing a variety of radioactively labeled biological molecules.

Radioimmunoassay procedures generate large volumes of liquid radioactive waste solutions. Since the introduction of radioimmunoassay (RIA) techniques by Yallow and Berson (Yallow, R. S., Berson, S. A., *Journal of Clinical Investigation,* 1960, 39:1157–1175) in the late 1950s, RIA technologies have become one of the most widely used analytical methods in the field of diagnostics and in many other biotechnology related-fields for the quantitative analysis of many substances.

The RIA methods gained popularity because of their high accuracy and sensitivity which nonradioisotopic methods lack. Notwithstanding its sustained popularity, the radioactive waste associated with the use of RIA procedures presents a major problem. Following the completion of the RIA assay, the resultant radioactive waste must be disposed of in a safe and secure manner, often requiring a large storage space and special lead-lined containers.

RIA procedures can be performed in a variety of different formats. An example of a typical RIA format is useful to illustrate how liquid radioactive waste is generated from these procedures. In a typical RIA procedure, a specific antigen together with a radioactively labelled antigen competes for a limited amount of the antibody or binder specific to that antigen. The antibody:antigen (Ab:Ag) complex is then separated from unbound antigen by various physical, chemical, physicochemical, or immunochemical methods. The radioactivity of the bound or free fractions is then measured and compared to a reference or standard to determine the amount of unknown antigen.

Many RIA variations have been developed and described in detail in literature (Miles, L. E. M., Hales, C. N., *Nature,* (1968), 219:186–189; Miles et al. *Analytical Biochemistry* (1974) 61:209–224). One example is the immunoradiometric assay (IRMA) in which the antibody, as opposed to antigen, is labeled with an isotopic material. In the IRMA technique, a sample containing an antigen is incubated with an excess amount of antibody (also called capture antibody) specific to an antigenic determinant on the antigen, in order to capture all of the antigen in the sample. This step is followed by the addition of radioisotope-labeled antibody, specific to a different antigenic site on the same antigen. An Ab:Ag:Ab-radioisotope complex is thus formed. The unbound radioactive antibodies are then separated from the Ab:Ag:Ab-radioisotope complex by removal of the excess solution. The bound radioactivity is then quantified by using a radioactive counter. The unknown sample results are then compared with results from a standard solution in order to measure the concentration of the unknown sample. Antibody or antibodies used in the above techniques may be polyclonal from various species (e.g. donkey, sheep, goat, rabbit, mice, human, etc.) or monoclonal antibodies from the above-named species.

A variety of separation techniques and materials used to separate the bound from free fractions in RIA techniques are known to those of skill in the art. Examples of such methods are listed in Table A below.

TABLE A

| METHOD OF SEPARATING BOUND AND FREE ANTIGEN | |
|---|---|
| Type of Method | Specific Method or Material Used |
| 1. CHEMICAL | |
| Precipitation | ethanol, polyethylene glycol, sodium sulphate, etc. |
| 2. PHYSICAL | |
| Gel filtration | Sephadex |
| Electrophoresis | on starch gel, cellulose acetate, etc. |
| Chromatography | paper, silica gel, etc. |
| Chromato electrophoresis | |
| Ion exchange | |
| Adsorption (free fraction) | charcoal, magnetizable talc, etc. |
| 3. IMMUNOLOGICAL | |
| Precipitation with second Ab | Second Antibody procedure |
| Solid-phase first Ab | |
| * Polymerization of first Ab | |
| * Entrapment | first antibody entrapped in cross-linked albumin |
| * Adsorption | polystyrene derivatives, paper discs, etc. |
| * Covalently coupled | CNBr-activated cellulose, magnetizable cellulose, sepharose, etc. |
| Solid-phase second antibody | CNBr-activated cellulose, magnetizable cellulose, sepharose, etc. |

Consideration of the various separation techniques used in RIA procedures illustrates why RIA procedures often generate large volumes of liquid radioactive waste. For example solid phase separation methods typically involve washing solid phase immunocomplexes containing a labeled antigen or antibody with an aqueous wash solution, which generates a large volume of low level liquid radioactive waste.

The various RIA techniques use a variety of different radioisotope labels. $^{14}C$, $^{3}H$, $^{125}I$, $^{131}I$, $^{32}P$ and $^{57}Co$ are among the most popular radioisotopes used in assay techniques in the medical, medical-diagnostic, and other biotechnology fields. Other radioisotopes not mentioned may also be utilized.

A large variety of different biological molecules are used in radioimmunoassay techniques in medicine and research. Common radioactively labeled molecules used in clinical laboratory testing include hormones such as $^{125}I$ thyroid hormones, $^{125}I$ steroids such as cortisol, testosterone and estrogenic hormones, and a variety of $^{125}I$ polypeptide hormones such as TSH, LH, FSH, HCG, etc. Other commonly used radioactively labeled molecules in RIA's include drugs such as $^{125}I$ digoxin, vitamins such as $^{125}I$ folate and $^{57}Co$ vitamin B12, as well as labeled antibody molecules used in IRMA procedures. Many other radioactively labeled molecules present in liquid radioactive waste are known to those of skill in the art and can also be concentrated by the methods of the invention.

Methods of separating radiolabeled biological molecules from liquid radioactive waste solutions The present invention involves adding a variety of solid phase binders including resins and adsorbent materials to a solution containing radioactively labeled biological molecules. These resins and adsorbent materials include adsorbent materials that are entrapped inside a resin or resins, or that are chemically coupled to a resin. The radioactive molecules are bound to the solid phase binder through physical, physiochemical, or immunochemical means during an incubation period. The immobilized radioactive molecules can then be separated and hence concentrated. The separation procedure removes the radioactively labeled biological molecule from the liquid radioactive waste solution, thereby concentrating the volume of radioactive material. Separation can be achieved by a variety of methods including filtration or centrifugation. Separation can also be achieved by magnetizable particle separation, if the resin or adsorbent materials have magnetic or paramagnetic properties. In addition, any of the separation techniques used in immunoassays and shown in table A or described in Ratcliffe, J. G., et al. (1974) *Br. Med. Bull.* 30(1) 32–37 or in Yalow, R. S. (1968) *Exc. Med. Found. Int. Congr. Ser.* 161: 627–631 can be used to remove radioactively labeled biological molecules from liquid radioactive waste solutions. Other physical separation techniques commonly known to those skilled in the art can also be employed.

A variety of solid phase binders can be used in the claimed methods. The term "solid phase binder" as used herein refers to any solid phase preparation that is capable of binding a radioactively labeled biological molecule present in a liquid solution. Solid phase binders are used to remove radioactively labeled biological molecules from liquid solution. A wide variety of solid phase binders can be used. For example, solid phase binders may be used that are based on known methods for separating bound from free radiolabeled molecules in radioimmunoassay procedures. A number of such separation methods are listed in Table A herein. Additional separation methods for radioimmunoassay procedures which describe additional materials for use as solid phase binders are described in Ratcliffe, J. G., et al. supra and in Yalow, R. S. (1968) supra. A variety of solid materials may be used as solid supports in solid phase binders. Examples of such solid materials including many plastics such as nylon, polyacrolein, polystyrene, polypropylene, cellulose, agarose, as well other polymers, copolymers, glass, porous glass, and other naturally occurring resins.

Figure 2:
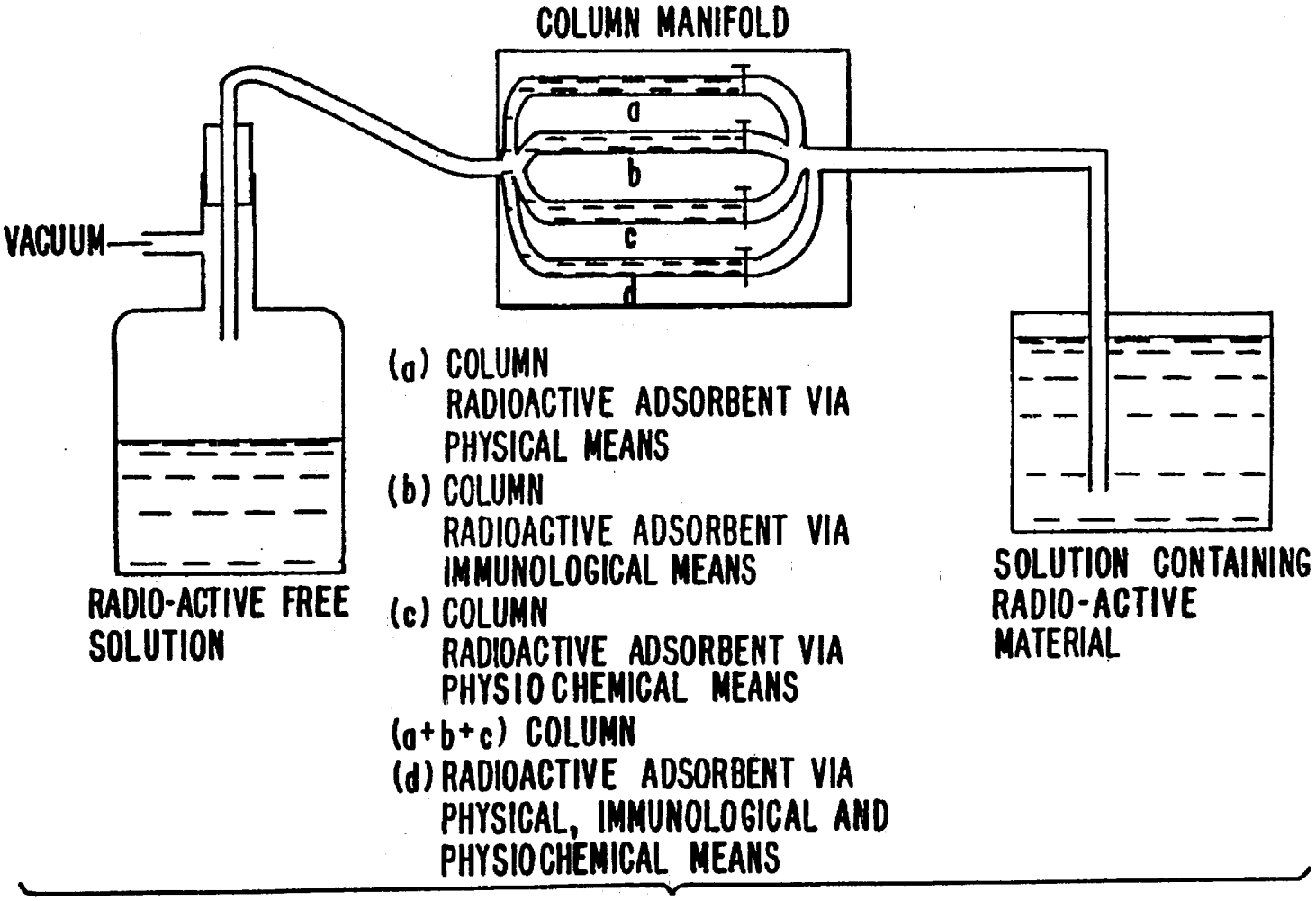
FIG. 2. Columns capable of removing a variety of radioisotope labeled materials from a solution. Four columns, each capable of adsorbing one or several types of radioisotope labeled materials from solutions are grouped together in a column manifold. A solution containing the radioactively labeled material is passed through the column manifold by application of a vacuum. Valves located at the front of each column allow the liquid waste solution to pass through one or more of the four columns, depending on the specific type of radioactively labeled biological molecules present in the radioactive waste solution.
Figure 3:
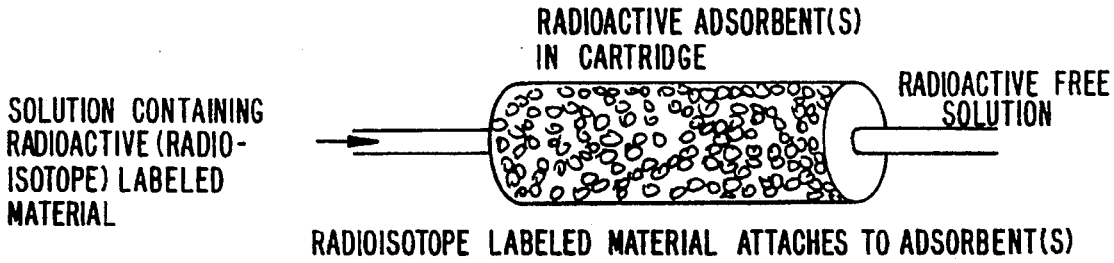
FIG. 3 Column cartridges capable of removing one or more types of radioisotope material from a solution. A single cartridge can be used in the configuration shown in the top diagrams. Four cartridges are ganged together in a manifold configuration as demonstrated in the middle diagram. In the bottom diagram, four different types of resins with different methods of removing radioactive materials are present in four sequential cells in a single cartridge.
Figure 3:
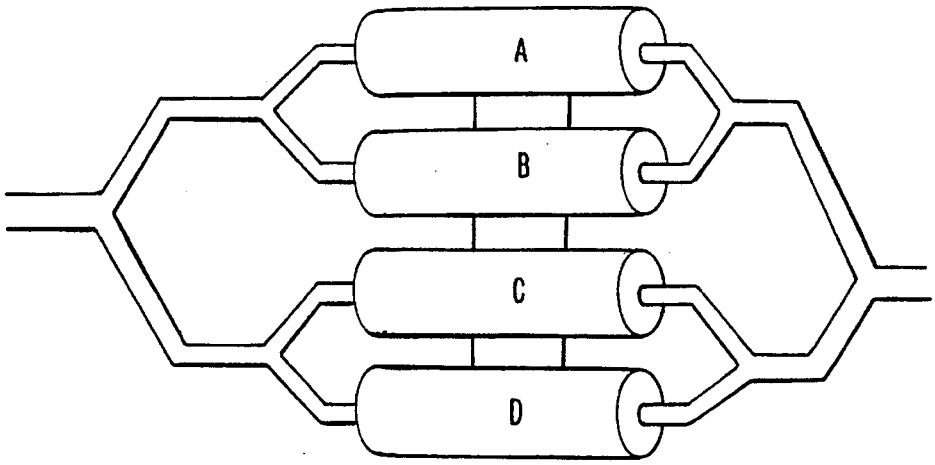
Figure 3:
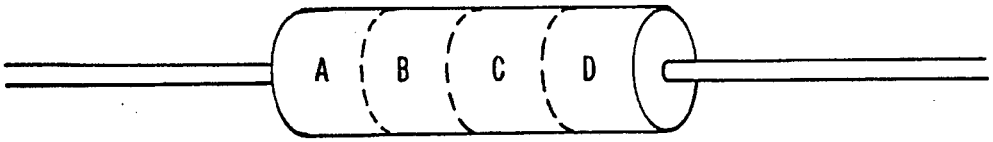

Adsorbents entrapped or chemically bound to a resin or resins can be packed in a column or packaged as a cartridge or any other resin containment device, holder, or container. The solution containing radioactively labeled biological molecules is then passed through the column, cartridge device, holder, or container resulting in removal of the radioactively material. In order to facilitate flow of liquid through the column, adsorbent particles can be incorporated into a polymer matrix. The polymer containing the adsorbent particles can then be used in a column or cartridge as described above. As an additional example, an adsorbent can be attached to a porous glass support such as porous glass beads. The porous glass beads are then packed into a column or cartridge which can be used to remove radioactively biological molecules from radioactive waste solutions. The use of several different column or cartridge configurations in the present invention is shown in FIGS. 1–3 herein. A variety of other column or cartridge configurations known to those of skill in the art can also be used.

This invention also includes methods by which radioisotope-labeled compounds (e.g. small compounds such as steroids, thyroxin hormones, therapeutic drugs, etc.), that are present in a liquid solution can be adsorbed by activated charcoal particles. The particles containing the radioisotope-labeled compounds adsorbed to it can then be concentrated by means of centrifugation or filtration.

A particular example of the use of a charcoal adsorbent is granulated-activated charcoal packed in a column, cartridge, or other containment device. The liquid solution containing the radioisotope-labeled material is then passed through the column or other device, by gravity or by the use of a pump, vacuum, or whichever is suitable. The radioisotope-labeled material is adsorbed in the column or device, hence concentrated for easy storage and disposal. Examples of the use of such columns are shown in FIGS. 1–3 herein. For instance, charcoal adsorbents can be used in the column formats shown in FIG. 1.

The term "solid phase adsorbent" as used herein refers to a particular type of solid phase binder that binds radioactively labeled biological molecules by the process of adsorption of the biological molecule to the surface of the adsorbent. A wide variety of different adsorbents may be used in solid phase adsorbents. An example of a solid phase adsorbent is a charcoal adsorbent.

The term "charcoal adsorbent", as used herein refers to any solid phase adsorbent which contains charcoal. The charcoal adsorbent can be particles of treated or untreated charcoal. Alternatively, the charcoal adsorbent can be particles of charcoal that are attached to a variety of different solid supports. For example, charcoal particles can be entrapped within a polymer such as polyacrylamide. As an additional example, charcoal-can be attached to a porous glass support. In both examples, the charcoal adsorbent is preferably packed into a cartridge or column and the radioactive waste solution is passed through the column or cartridge in order to remove radioactively labeled biological molecules.

A wide variety of other adsorbents in addition to charcoal can be used as solid phase adsorbents. For example, silicates such as talc and Fuller's earth, can be used. Glass beads and glass wool can also be used as adsorbents for certain biological molecules such as DNA. Solid phase adsorbents can also be mixture of different substances as, for example, mixtures of celite and charcoal. Solid phase adsorbents can be particles of an adsorbent or can be attached to a polymer or entrapped within a polymer resin. As described above, these adsorbents can also be entrapped within a polymer resin, which can have advantages for use in columns and cartridges.

A large number of naturally occurring or synthetically prepared adsorbents or resins have the ability to bind many radioisotope-labeled materials. However, some radioisotope-labeled compounds cannot be readily adsorbed to solid phase adsorbents. These types of molecules can generally be removed from liquid radioactive waste solutions by use of a solid phase immunochemical binder. An antibody, or a naturally or synthetically produced binder, or a genetically engineered binder specific for a radioisotope-labeled compound can be bound to a solid support such as a resin. The solid support can then be mixed with the contaminated solution to bind the radioisotope-labeled biological molecule. After a brief incubation, the solid support can be separated by a variety of techniques such as centrifugation or filtration. As an additional example, the antibody can be physically adsorbed or chemically bound to a variety of magnetizable solid-supports to implement easy separation. The radioactive waste solution can be concentrated by a factor of a hundred or more for easier disposal.

A solid phase immunochemical binder, such as a solid phase antibody, can also be packed in a column, cartridge, or other device, and the solution containing radioisotope-labeled compounds can be passed through the column by means of gravity, pump, or vacuum to facilitate and accelerate the decontamination procedure.

The term "solid phase immunochemical binder" as used herein, refers to those solid phase binders that use antibody-antigen binding to accomplish the binding of a radioactively labeled biological molecule to a solid phase binder. The term also includes the binding of radioactively labeled antibodies in liquid radioactive waste solutions by non-immunoglobulin proteins such as protein A, protein G combined protein A-protein G molecules (protein A/G). Typically, a solid phase immunochemical binder has an antibody capable of binding a radioactively labeled biological molecule coupled to a solid phase. Alternatively, an antigen can be coupled to a solid phase and used to bind radioactively labeled antibodies that are present in radioactive waste solutions. As yet another example, antibodies that bind radioactively labeled biological molecules can be added to a radioactive waste solution in liquid phase to form an immunocomplex with a radioactively biological molecule. The immunocomplex can be bound by a solid phase reagent capable of binding the liquid phase antibody. Examples of such solid phase reagents include anti-immunoglobulin antibodies, protein A, protein G, or protein A/G coupled to a solid phase.

The term "antibody" as used herein, refers to an immunoglobulin molecule able to bind to a specific epitope on an antigen. Antibodies can be a polyclonal mixture or monoclonal. Antibodies can be intact immunoglobulins derived from natural sources or from recombinant sources and can be immunoreactive portions of intact immunoglobulins. Antibodies are typically tetrameres of immunoglobulin polypeptide chains. The antibodies may exist in a variety of forms including, for example, Fv, $F_{ab}$, and $F(ab)_2$, as well as in single chains (e.g., Huston, et al., *Proc. Nat. Acad. Sci. U.S.A.*, 85:5879–5883 (1988) and Bird, et al., *Science* 242:423–426 (1988), which are incorporated herein by reference). (See generally, Hood, et al., *Immunology*, Benjamin, N.Y., 2nd ed. (1984), and Hunkapiller and Hood, *Nature*, 323:15–16 (1986), which are incorporated herein by reference). Single-chain antibodies, in which genes for a heavy chain and a light chain are combined into a single coding sequence, may also be used.

There are also many other types of solid phase binders that can be used in addition to solid phase adsorbents and solid phase immunochemical binders. Some of these binders are used for binding specific types of labeled biological molecules. For example, solid phase oligonucleotides can be used to hybridize to complementary radiolabeled nucleic acids that are present in radioactive waste solutions. Hydroxyapatite and other substances that bind nucleic acids can also be used to bind radioactively labeled nucleic acids.

As described above, solid phase binders remove radioactively labeled biological molecules from liquid radioactive waste solutions by forming a complex between the solid phase binder and the radioactively biological molecules. The term "solid phase binder:radioactively labeled biological molecule complex" refers to the complex formed when a solid phase binder binds to a radioactively labeled biological molecule. The type of binding in the complex will vary depending on the type of solid phase binder that is used. For example, solid phase adsorbents adsorb certain radioactively labeled biological molecules to the surface of the adsorbent. As another example, solid phase immunochemical binders use antibody-antigen binding in the formation of the solid phase binder:radioactively labeled biological molecule complex.

As described above, there are a variety of methods for removing the solid phase binder:radioactively labeled biological molecule complex from the radioactive waste liquid. For example, magnetizable particle binders can be used to effect this separation. The term "magnetizable particle binder" as used herein refers to a solid phase binder that uses a magnetizable particle as the solid phase. There can be a variety of different types of magnetizable particles. These particles can use different magnetizable constituents as well as different polymers to form the solid phase. There are a variety of different magnetizable constituents that can be used in the particle. Typically, the magnetic constituents are not magnetized metals, but rather metallic constituents that can be attracted by magnet. However, particles with magnetic properties can also be used. Typical examples of magnetizable constituents include ferric oxide, nickel oxide, barium ferrite, and ferrous oxide. A variety of different polymers or resins can be also used in the magnetizable particle. Examples of such polymers include polyacrylamide, polyacrolein and cellulose. The term "magnetizable polymer", as used herein refers to a polymer containing a magnetizable constituent. Polyacrylamide, polyacrolein and cellulose polymers which have incorporated iron oxide particles are examples of magnetizable polymers. The term "magnetizable polyacrylamide gel" refers to a polyacrylamide gel that has incorporated a magnetizable constituent such as iron oxide. A variety of magnetizable particle binders, their use and methods of their preparation are described in Pourfarzaneh, M., et al. (1982) *Methods of Biochemical Analysis* 28:267–295.

Magnetizable particle binders can use any of the binding principles used for other solid phase binders. For example, magnetizable particle binders can have adsorbent particles attached to or incorporated into a magnetizable particle. These particles can bind biologically labeled radioactive molecules by the process of adsorption. Magnetizable particle binders can also be solid phase immunochemical binder. The term "magnetizable particle immunochemical binder" refers to a solid phase immunochemical binder wherein the solid phase is a magnetizable particle.

The term "magnetizable particle binder:radioactively labeled biological molecule complex" as used herein, refers to the complex formed when a magnetizable particle binder binds to a radiolabeled biological molecule. The type of binding in the complex varies depending on the binder that is used in magnetizable particle binder. For example, magnetizable particle immunochemical binders use antigen-antibody binding in the formation the magnetizable particle binder:radioactively labeled biological molecule complex.

The magnetizable particle binder:radioactively labeled biological molecule complex is removed from the liquid radioactive waste solution by application of a magnetic field. This method can be applied to liquid radioactive waste solutions containing more than one radioactively labeled biological molecule. For example, a number of different magnetizable particle binders capable of binding different radioactively labeled biological molecules can be added to a liquid radioactive waste solution which contains more than one radioactively labeled biological molecule. The resultant magnetizable particle binder:radioactively labeled biological molecule complexes can then be removed by applying a magnet to the liquid radioactive waste solution.

Preparation of solid phase binders

The various solid phase binders as described herein can be prepared by methods known to those of skill in the art. For example, magnetizable polymers can be prepared as described in Pourfarzaneh, M. (1980) "Synthesis of Magnetizable Solid Phase Supports for Antibodies and Antigens and their Application to Isotopic and Non-isotopic Immunoassay" Medical College of St. Bartholomew's Hospital, University of London, London, U.K. and in Pourfarzaneh, M. et al. (1982) supra. For example, iron oxide can be incorporated into a polyacrylamide or polyacrolein gel during the polymerization reaction as described in Pourfarzaneh, M. (1980) supra. Magnetizable cellulose can be also be prepared from cellulose and iron oxide as described in Pourfarzaneh, M. (1980) supra. A variety of other magnetizable polymers can also be prepared by similar methods or by other methods known to those of skill in the art.

Methods of preparing solid phase immunochemical binders are also well known to those of skill in the art. For example, antibodies can be attached to various solid phases by methods used for constructing immunoassay solid supports. See *Enzyme Immunoassay,* E. T. Maggio, ed., CRC Press, Boca Raton, Florida (1980); "Practice and Theory of Enzyme Immunoassays," P. Tijssen, *Laboratory Techniques in Biochemistry and Molecular Biology,* Elsevier Science Publishers B. V. Amsterdam (1985); and, Harlow and Lane, *Antibodies: A Laboratory Manual,* Cold Spring Harbor Pubs., N.Y. (1988), each of which is incorporated herein by reference.

Magnetizable particle binders including magnetizable particle adsorbents and magnetizable particle immunochemical binders can be prepared as described in Pourfarzaneh, M. et al. (1980) supra and Pourfarzaneh, M., et al. (1982) supra. Antibodies and other proteins and peptides of interest can be coupled to a variety of magnetizable polymer solid supports using methods known in the art. For example, antibodies and other proteins can be coupled to CNBr-activated magnetizable cellulose and to glutaraldehyde activated magnetizable polyacrylamide using standard procedures (see Pourfarzaneh, M. et al. (1980) supra). In addition, polymers such as polyacrolein have highly reactive aldehyde groups on their surface which can be coupled to primary amino groups of proteins (see Pourfarzaneh, M. et al. (1980) supra). A number of other polymer and protein chemistry reactions known to those of skill in the art can also be used to couple antibodies and other proteins to the magnetizable polymers of the invention.

In addition to the magnetizable particle immunochemical binders, other magnetizable particle binders are also prepared by methods known to those of skill in the art. For example, magnetizable particle adsorbents such as such as charcoal particles entrapped in a magnetizable polymer matrix can be prepared as described in Pourfarzaneh, M. et al. (1980) supra and Pourfarzaneh, M., et al. (1982) supra.

There are also a variety of other solid phase binders which are described herein. These solid phase binders can all be produced by methods well known to those of skill in the art. Preparation of the columns and cartridges containing solid phase binders is done using standard chemistry and biochemistry techniques.

While the methods described herein are directed toward the removal of radiolabeled biological molecules from radioactive waste solutions, it is also contemplated that these methods can also be applied to many other decontamination problems such as extraction of chemical, bacterial, or viral components from various liquids. For example, chemical manufacturing plants often generate aqueous liquids containing toxic compounds that must be removed before the aqueous liquid can be further processed or released into the environment. Some of these compounds can removed by using solid phase adsorbents such a charcoal adsorbents, for example, in a column format. Other such compounds can be removed by other solid phase binders described herein such as solid phase immunochemical binders.

EXAMPLES

EXAMPLE 1

Removal of $^{125}$I thyroxine from a liquid solution with a solid phase charcoal binder A celite-charcoal column was prepared by placing a layer of glass wool in the bottom of a 50 ml plastic syringe, covering this with a glass fiber disc and then a sludge comprising 4 grams of charcoal (MFC, 300 mesh, Hopkins and Williams Ltd., Chadwell Health, U.K.) and 1 gram of celite (Sigma Chemical Co., St. Louis, Mo., USA) suspended in distilled water. A trace amount of $^{125}$I-Thyroxin (~10,060 CPM) (prepared as described in Pourfarzaneh, M. (1980) supra) was added to 100 ml of distilled water and was gently layered on the surface and allowed to pass through the charcoal column. The efficiency of extraction, usually greater than 98%, was checked by measuring the radioactivity in the eluate.

EXAMPLE 2

Removal of $^{125}$I folate and $^{57}$Co vitamin B12 from a liquid solution with a magnetizable particle charcoal adsorbent Using a pipette, 100 μl of $^{57}$Co-$B_{12}$ (Vitamin $B_{12}$) and $^{125}$I-Folate (Bio-Rad Corp., Hercules, Calif., USA) was added to a 120×8 mm polypropylene test tube followed by 1000 μl of distilled water. Magnetizable Polyacrylamide Charcoal Particles (Cortex Biochem Inc., San Leandro, Calif., USA), 5 mg (100 μl) was added to the above radioactive mixture and then vortex-mixed briefly. Polyacrylamide magnetizable particles containing charcoal are prepared as described Pourfarzaneh, M. et al. supra. The mixture was then allowed to incubate for 10 minutes while the particles gravity settled. The tube was placed on a magnet and the liquid (1050 μl) pipetted into a separate tube. The radioactivity of the liquid and tubes containing magnetizable charcoal were then measured in a radioactive counter. Table B summarizes the results obtained.

TABLE B

| Radioactive material | Radioactivity prior to addition of magnetizable charcoal, (CPM)* | Radioactivity absorbed by magnetizable charcoal, (CPM) | Radioactivity remaining in supernatant, (CPM) |
|---|---|---|---|
| $^{57}$Co-BI2 | 4227.8 | 4429.0# | 37.3■ |
| $^{125}$I-Folate | 2548.2 | 2786.0# | 85.0■ |

*CPM = Count per minute

TABLE B-continued

# = This amount of radioactivity appears to be higher than the original sample. This is due to the radioactivity being concentrated by the magnetizable particles into a smaller volume when the particles were gravity settled.
■ = These values are equivalent to background radioactivity.

As shown in Table B, various radioactive materials can be adsorbed and removed or concentrated from solutions by this technique. The concentration factor can be from several to many thousandfold.

EXAMPLE 3

Removal of $^{125}$I thyroxine from a liquid solution with a magnetizable particle immunochemical binder Into a polypropylene test tube, 100 μl of $^{125}$I-Thyroxin ($^{125}$I-T4) (Incstar Corp. Minneapolis, Minn., USA) was added with 100 μl of T4 mouse monoclonal antibody. After a brief incubation, 100 μl (5 mg) of magnetizable cellulose chemically coupled to sheep anti-mouse antibody (Cortex Biochem Inc., San Leandro, Calif., USA) was added. The magnetizable cellulose chemically coupled to sheep anti-mouse antibody was prepared as described in Pourfarzaneh, M., et al. supra. The mixture was incubated further for 15 minutes at room temperature, after which, the radioactivity was measured. This was followed by addition of 1 ml of water to the mixture. The magnetizable particles were sedimented on a magnet and the supernate was transferred to another test tube. The radioactivity was measured in a radioactivity counter. Table C below summarizes the data obtained:

TABLE C

| Radioactive material (complex) | Total Radioactivity in the mixture (CPM) | Radioactivity absorbed by magnetizable particles (CPM) | Radioactivity remaining in supernatant (CPM) |
|---|---|---|---|
| $^{125}$I-T4-MAb* | 4412.1 | 3961.8 | 167.0 |

* = Monoclonal anti-thyroxin

As shown in the above examples, the radioisotope-labeled materials can be adsorbed and concentrated by using simple physical adsorption, or by physicochemical reactions, or by immunochemical complex formations.

It is understood that the examples and embodiments described herein are for illustrative purposes only and that various modifications or changes in light thereof will be suggested to persons skilled in the art and are to be included within the spirit and preview of this application and scope of the appended claims. All publications, patents, and patent applications cited herein are hereby incorporated by reference.

What is claimed is:

1. A method of removing a radioactively labeled biological molecule from a liquid radioactive waste solution comprising the steps of:

(a) contacting said liquid radioactive waste solution with a magnetizable particle binder to form a magnetizable particle binder:radioactively labeled biological molecule complex; and (b) separating said complex from said liquid radioactive waste solution by contacting said complex with a magnetic field to remove the radioactively labeled biological molecule from said liquid radioactive waste solution.

2. The method of claim 1 wherein said magnetizable particle binder comprises adsorbent particles attached to a magnetizable polymer.

3. The method of claim 2 wherein said adsorbent particles are charcoal particles.

4. The method of claim 2 wherein said magnetizable polymer is a magnetizable polyacrylamide gel.

5. The method of claim 4 wherein said magnetizable particle binder comprises charcoal particles entrapped in the magnetizable polyacrylamide gel.

6. The method of claim 5 wherein said radioactively labeled biological molecule is a mixture of $^{125}$I folate and $^{57}$Co vitamin B12.

7. The method of claim 1 wherein said magnetizable particle binder is a magnetizable particle immunochemical binder.

8. The method of claim 7 wherein said magnetizable particle immunochemical binder comprises an antibody attached to a magnetizable polymers.

9. The method of claim 8 wherein said magnetizable particle immunochemical binder comprises an antibody chemically coupled to a magnetizable cellulose polymer.

10. The method of claim 7 further comprising the step of binding said radioactively labeled biological molecule to a liquid phase antibody, wherein said magnetizable particle immunochemical binder binds to said liquid phase antibody to form the solid phase binder:radioactively labeled biological molecule complex of step (a).

11. The method of claim 10 wherein said magnetizable particle immunochemical binder comprises an antibody capable of binding to the liquid phase antibody.

12. The method of claim 11 wherein said radioactively labeled biological molecule is $^{125}$I thyroxine, said liquid phase antibody is a mouse antithyroxine antibody, and the magnetizable particle immunochemical binder comprises a sheep anti-mouse antibody.

* * * * *